US007216405B2

(12) United States Patent
Gradl

(10) Patent No.: US 7,216,405 B2
(45) Date of Patent: May 15, 2007

(54) TEARDROP SEALANT LAYER FOR PROFILE AND SPACER AREAS FOR IMPROVED SEALING AND GUIDING

(75) Inventor: Steven E. Gradl, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 98 days.

(21) Appl. No.: 10/810,747

(22) Filed: Mar. 25, 2004

(65) Prior Publication Data

US 2005/0210638 A1 Sep. 29, 2005

(51) Int. Cl.
*B65D 33/25* (2006.01)

(52) U.S. Cl. ..... 24/585.12; 24/DIG. 50

(58) Field of Classification Search ..... 383/5, 383/61, 61.2, 63–65, 61.3, 204, 210, 207, 383/208, 210.1; 24/30.5 R, 399, 400, 389, 24/585.12, DIG. 50; 53/133.4, 139.2
See application file for complete search history.

(56) References Cited

U.S. PATENT DOCUMENTS

| | | | | |
|---|---|---|---|---|
| 4,673,383 | A | 6/1987 | Bentsen | 493/381 |
| 4,691,373 | A | 9/1987 | Ausnit | 383/63 |
| 4,817,188 | A | 3/1989 | Van Erden | 383/63 |
| 4,835,835 | A | 6/1989 | Gould | 29/527.2 |
| 4,964,739 | A | 10/1990 | Branson et al. | |
| 5,063,644 | A | 11/1991 | Herrington et al. | 24/400 |
| 5,216,787 | A | 6/1993 | Custer et al. | 24/587 |
| 5,242,516 | A | 9/1993 | Custer et al. | 156/66 |
| 5,301,394 | A | 4/1994 | Richardson et al. | 24/399 |
| 5,366,294 | A | 11/1994 | Wirth et al. | 383/61 |
| 5,442,837 | A | 8/1995 | Morgan | 24/400 |
| 5,628,566 | A | 5/1997 | Schreiter | 383/63 |
| 5,638,586 | A * | 6/1997 | Malin et al. | 24/585.12 |
| 5,655,273 | A * | 8/1997 | Tomic et al. | 24/584.1 |
| 5,660,479 | A * | 8/1997 | May et al. | 383/204 |
| 5,664,329 | A | 9/1997 | Nickel | 29/894.324 |
| 5,729,876 | A | 3/1998 | Johnson | 24/587 |
| 5,747,126 | A | 5/1998 | Van Erden et al. | 428/35.2 |
| 5,749,658 | A * | 5/1998 | Kettner | 383/204 |
| 6,074,096 | A | 6/2000 | Tilman | 383/63 |

(Continued)

FOREIGN PATENT DOCUMENTS

| | | |
|---|---|---|
| EP | 0 985 605 | 3/2000 |

(Continued)

*Primary Examiner*—James R. Brittain
(74) *Attorney, Agent, or Firm*—Merchant & Gould P.C.

(57) ABSTRACT

A reclosable zipper for use with package, such as food and non-food packages, that include first and second mating profile members. Each of the first and second profile members of the zipper closure includes a pair of flanges each having a sealant layer. The sealant layer formed on each of the flanges protrudes past the outer surface of the flange such that the outer surface of the sealant layer contacts the film of web material. The sealant layer is formed from a material different than the material that forms the remaining portions of the first and second profile members such that the sealant layer melts and forms a bond with the web material upon the application of heat. Each of the profile members includes a standoff area formed along the inner surface of each flange to provide support for the flange during the application of the heating element.

17 Claims, 3 Drawing Sheets

U.S. PATENT DOCUMENTS

| | | | | |
|---|---|---|---|---|
| 6,154,934 | A | 12/2000 | Matthews | 24/587 |
| 6,481,890 | B1 | 11/2002 | VandenHeuvel | 383/64 |
| 6,691,375 | B1 | 2/2004 | Savicki | |
| 2002/0162200 | A1* | 11/2002 | Offa-Jones | 24/585.1 |

FOREIGN PATENT DOCUMENTS

| | | |
|---|---|---|
| WO | WO 02/062672 | 8/2002 |
| WO | WO 03/003871 | 1/2003 |

* cited by examiner

TEARDROP SEALANT LAYER FOR PROFILE AND SPACER AREAS FOR IMPROVED SEALING AND GUIDING

FIELD OF THE INVENTION

The present invention generally relates to the reclosable zipper for the application between a pair of side panels of a reclosable package. More particularly, the present invention relates to a reclosable zipper that includes a sealant layer on the flanges of both a first profile member and a second profile member to facilitate attachment of the reclosable zipper to the side panels of a reclosable package.

BACKGROUND OF THE INVENTION

In the field of packaging, particularly in the area of food packaging, it is often desirable to package items in a package that may be repeatedly opened and closed. For example, when dealing with packaged foods, the consumer may initially use only a portion of the food contained within one package. By providing a package that may be reclosed by the consumer, the consumer avoids having to locate a storage container for the unused portion of the food in the package. It will be appreciated that reclosable packaging enhances the marketability of such products.

To facilitate the manufacturing of packages including a reclosable seal, the reclosable seal is often provided in the form of a continuous profile strip that may be manufactured independently from the package itself. The profile strip is typically wrapped onto a spool or reel for storage until it is needed to complete the packaging process.

When a product is packaged, the profile strip is unwound from its storage spool and attached to the packaging substrate during the packaging process. Typically, the profile strip is attached to each of the side panels of the product package by heating a flange on each of the pair of mating profile members and the side panels of the bag simultaneously. Because both the profile members and the bag material are typically formed from the same material, such as polyethylene, the two components melt together forming a sufficient seal.

One disadvantage of the use of a heated sealing bar to attach the first and second profile members of a profile strip to the opposite panels of a reclosable bag is that during the heating process, the generally planar flanges of each of the first and second profile members can be distorted due to the heating process.

Reclosable zippers having one or more fusible ribs for sealing the zippers to the package material are known in the reclosable packaging art. Such zippers are found in U.S. Pat. Nos. 4,673,383, 5,216,787 and 5,242,516.

Although the prior art shows examples of fusible ribs and sealant layers used to attach a profile strip to a reclosable package, the configuration and construction of the profile strip requires improvement.

SUMMARY OF THE INVENTION

The present invention is directed to a zipper closure for use along a mouth of a flexible, reclosable package. The zipper closure is preferably formed as a continuous strip during an extrusion process and is subsequently applied between the first and second panels of a reclosable package, such as with a form, fill and seal (FFS) machine.

The zipper closure of the present invention includes first and second mating profile members that each include a base and an interlocking closure element extending from the base. The first and second profile members are configured such that the interlocking closure elements of each engage each other to hold the first and second profile members in an engaged, closed position. Both the first profile member and the second profile member include a pair of flanges that each extend from the base of the respective profile member. The flanges are used to attach the respective profile member to opposite side panels of a flexible web used to create the product package.

Each of the flanges includes an inner surface and an outer surface. The outer surface of each flange faces the web material used to form the product package. In accordance with the present invention, the outer surface of each flange includes a sealant layer formed near the outermost edge of the flange. The sealant layer has a generally teardrop shape and includes an outer surface that protrudes away from the generally planar outer surface of each flange. Thus, when the first and second profile members are brought into contact with a layer of web material, the outer surface of each of the sealant layers contacts the inner surface of the web material. In this manner, an open air gap is formed between the layer of web material and the outer surface of the base of each of the first and second profile members.

Each of the sealant layers can be extruded with the remaining portions of the first and second profile members. The sealant layers are preferably formed from a second material while the remaining portions of the first and second profile members are formed from a first material. Preferably, the first material is a low density polyethylene, while the second material that forms the sealant layer is an ethyl vinyl acetate (EVA) sealant layer that melts at a lower temperature than the low density polyethylene.

Each of the first and second profile members includes at least one standoff area formed on the inner surface of each of the flanges of the profile members. Each standoff area extends away from the otherwise planar inner surface of the flange such that each of the standoff areas extends toward the opposing profile member. Preferably, each of the standoff areas are formed near the outermost edge of the respective flange such that each of the standoff areas are generally aligned with one of the sealant layers. During the application of the zipper closure to the web material, each of the standoff areas contacts a zipper guide plate to provide support for the sealant layer during the pressure application of a heated sealing bar. The interaction between the standoff areas and the guide plate prevents deflection of the flanges and aids in the attachment of the sealant layers to the web material.

DETAILED DESCRIPTION OF PREFERRED EMBODIMENTS

Figure 1:
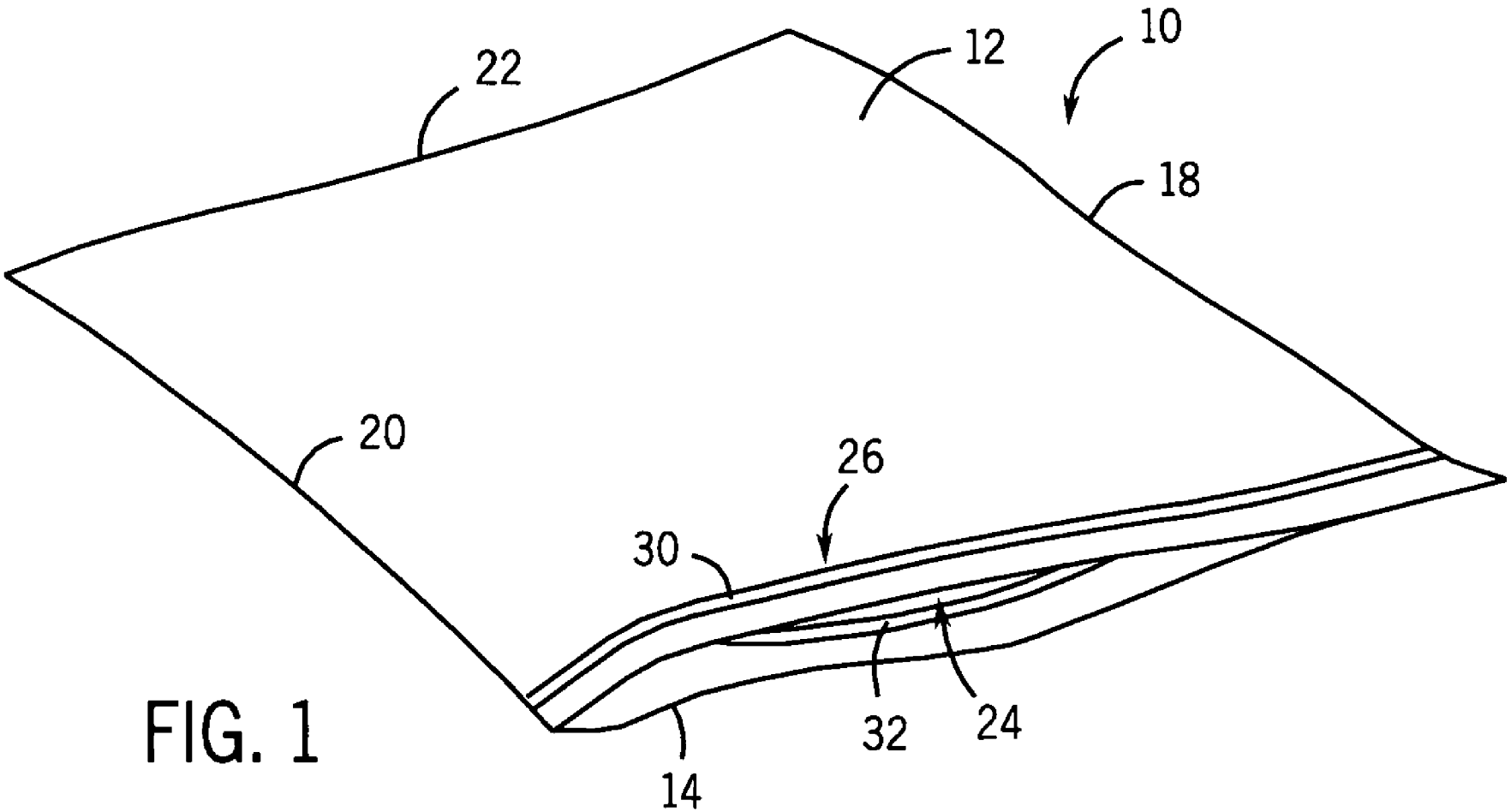
FIG. 1 is a perspective view of a reclosable package incorporating the zipper closure of the present invention.

FIG. 1 illustrates a flexible, reclosable package 10. The flexible package 10 has a first and a second polymeric film side panels 12, 14 defining an open interior. The flexible package includes a pair of side edges 18, 20 and a bottom edge 22. The pair of side panels 12 and 14 are connected to each other along the side edges 18 and 20 as well as the bottom edge 22 to form the open interior of the package 10. The first side edge 18 and the second side edge 20 are seals created by the application of heat and pressure for a set period to the side panels 12 and 14.

As shown in FIG. 1, a mouth 24 provides access to the interior of the package 10 along the top of the package. A zipper closure 26 is formed along the mouth 24 and extends from the first side edge 18 to the second side edge 20. The zipper closure 26 can include a variety of configurations and structures.

As illustrated in FIG. 1, the zipper closure 26 generally includes a first profile member 30 attached to the side panel 12 and a second profile member 32 attached to the opposite side panel 14. The first and second profile members 30, 32 are configured and arranged to interlock with each other to provide a generally fluid type seal across the mouth 24 when the zipper closure 26 is in its fully mated, sealed position.

In many applications, the zipper closure 26 is formed using an extrusion process, as will be described in much greater detail below, and is provided as a continuous strip of material wound onto a roll or spool and is provided packaging facility. Once in the packaging facility, the continuous strip of the zipper closure 26 is applied between opposing sheets of a flexible web in a form, fill and seal (FFS) machine. While in the form, fill and seal machine, the first and second profile members 30, 32 are attached to the opposing side panels 12, 14 using a heat application process. During the same process, the side edges 18, 20 are also formed through the application of heat.

Figure 2:
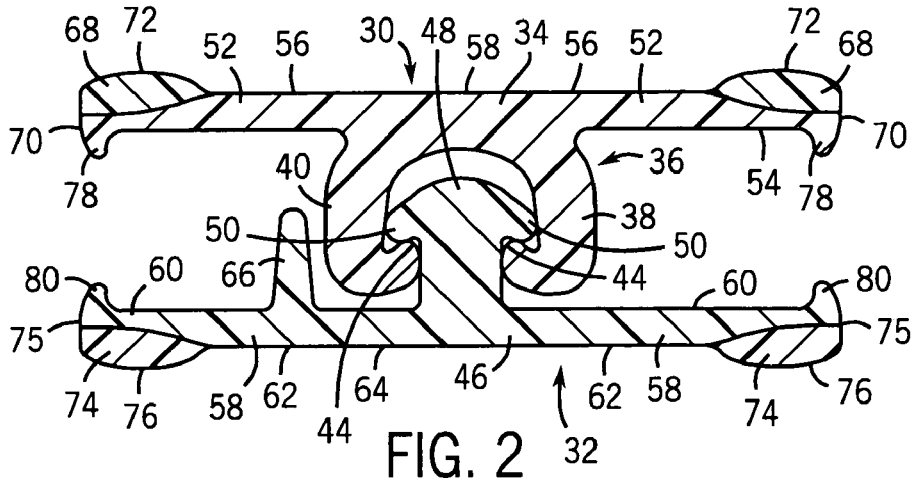
FIG. 2 is a section view of the mated reclosable zipper of the present invention as extruded.

Referring now to FIG. 2, thereshown is the zipper closure 26 in its mated condition prior to the application of the zipper closure 26 to the reclosable package. The zipper closure 26 includes the first profile member 30 and the second profile member 32. The first profile member 30 includes a base 34 and an interlocking closure element 36 extending from the base 34. In the embodiment illustrated in FIG. 2, the interlocking closure element 36 is a female closure element having a pair of spaced engagement posts 38, 40 that define the receiving opening 42. Each of the engagement posts 38, 40 includes a protruding locking hook 44 that functions to engage the mating second profile member 32, as will be described in greater detail below.

The mating second profile member 32 also includes a base portion 46 having an interlocking closure element 48 extending therefrom. In the embodiment illustrated in FIG. 2, the interlocking closure element 48 is a male closure post having a pair of protruding locking ribs 50. The locking ribs 50 engage the locking hooks 44 to secure the first and second profile members 30, 32 in the engaged position shown in FIG. 2.

As illustrated in FIG. 2, the first profile member 30 includes a pair of flanges 52 extending in opposite directions from the base 34. Each of the flanges 52 includes an inner surface 54 and an outer surface 56. The flanges 52 are integrally formed with the base 34 and the interlocking closure element 36 during an extrusion process. As illustrated in FIG. 2, the outer surface 56 of each of the flanges 52 creates a generally planar surface area with the outer surface 58 of the base 34.

The second profile member 32 also includes a pair of flanges 58 integrally formed with the base 46. Each of the flanges 58 includes an inner surface 60 and an outer surface 62. The outer surface 62 of each flange is generally coplanar with an outer surface 64 of the base portion 46. In the embodiment of the invention illustrated, one of the flanges 58 of the second profile member 32 includes an upstanding sealing flange 66 that is typically positioned toward the open interior of the package and aids in providing a seal across the open mouth of the product package.

In the embodiment of the invention illustrated, the flanges and base portion of both the first and second profile members 30, 32 are formed from the same material, such as a low density polyethylene. This type of material is typically used in the formation of an interlocking zipper closure 26. Although low density polyethylene is shown and described in the preferred embodiment, other similar materials are contemplated.

As illustrated in FIG. 2, the first profile member 30 includes a pair of sealant layers 68 formed near the outermost edge 70 of each of the flanges 52. As illustrated, each of the sealant layers 68 is generally teardrop shaped and includes an outer surface 72 that protrudes outwardly of the outer surface 56 of each of the flanges 52 and the outer surface 58 of the base 34.

As illustrated, the second profile member 32 also includes a pair of sealant layers 74 formed near the outermost edge 75 of each of the flanges 58. Each of the sealant layers 74 is also teardrop shaped and includes an outer surface 76 that protrudes outwardly of the outer surface 62 of each of the flanges 58 and the outer surface 64 of the base 46.

In the embodiment of the invention illustrated in FIG. 2, the sealant layers 68, 74 are formed from a material different from the material used to form the remaining portions of both of the first and second profile members 30, 32. Specifically, each of the sealant layers 68, 74 is formed from a material having a lower melting point than the low density polyethylene used to form the first and second profile members 30, 32. Preferably, each of the sealant layers 68, 74 is formed from an EVA material that melts at a lower temperature than the low density polyethylene, for the reasons to be set forth below. Other materials, such as metallocene, are also contemplated for use as the sealant layers 68, 74.

Referring back to FIG. 2, the flanges 52 of the first profile member 30 each include at least one standoff area 78 formed at the outer edge 70 of the flanges 52. The standoff areas 78 each extend away from the inner surface 54 of the flange and toward the second profile member 32 when the profile members are in the mated condition shown in FIG. 2. The standoff areas 78 are each generally aligned with one of the sealant layers 68 formed on the outer surface 56 of the flanges 52.

The second profile member 32 also includes a pair of standoff areas 80 formed on each of the flanges 58. Each of the standoff areas 80 protrude from the inner surface 60 of the flanges 58 and toward the mating first profile member 30 when the profile members are in the mated condition shown in FIG. 2. The standoff areas 80 are each generally aligned with one of the sealant layers 74 formed on the outer surface 62 of the flanges 58.

Figure 3:
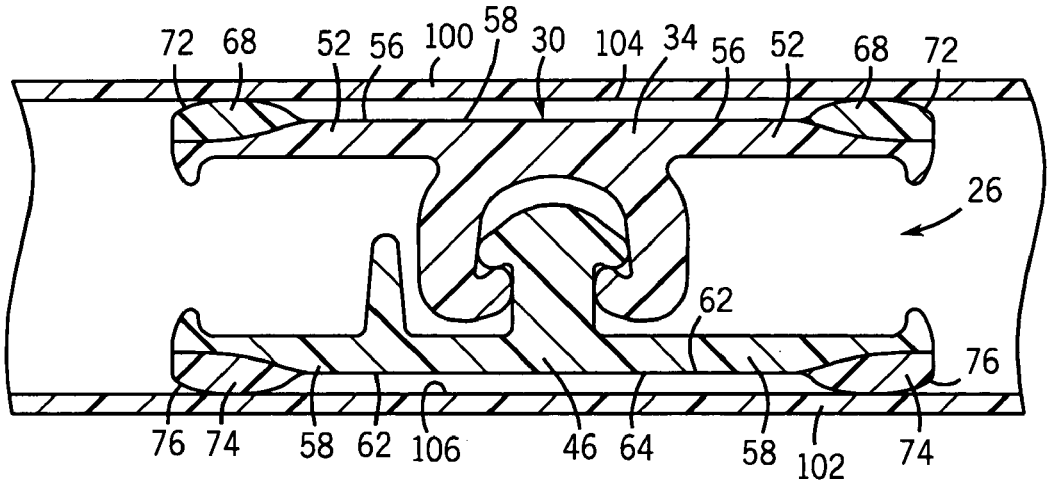
FIG. 3 is a section view of the reclosable zipper of the present invention prior to sealing to a web of film.

Referring now to FIG. 3, thereshown is the initial step in the application of the zipper closure 26 between a first layer of web material 100 and a second layer of web material 102.

During the formation of a product package, the first and second layers of web material 100, 102 may be joined to each other along a bottom fold or may be separate sections of polymeric film. In either case, after the zipper closure 26 has been attached to both the first and second layers 100, 102, the package side edges are formed such that the first and second layers of web material 100, 102 become the opposing side panels of the product package.

As illustrated in FIG. 3, when the web material 100, 102 is initially brought into contact with the mated zipper closure 26, the inner surface 104 of the first web 100 contacts only the outer surface 72 of the sealant layers 68. As illustrated, the inner surface 104 of the web material 100 is spaced from the outer surface 56 of the flanges 52 and the outer surface 58 of the base portion 34.

Likewise, the inner surface 106 of the second web 102 contacts only the outer surface 76 of the sealant layers 74 formed on the flanges 58 of the second profile member 32. The contact between the sealant layers 74 and the inner surface 106 provides a space between the inner surface 106 and the outer surface 62 of the flanges 58 and the outer surface 64 of the base portion 46.

Figure 4:
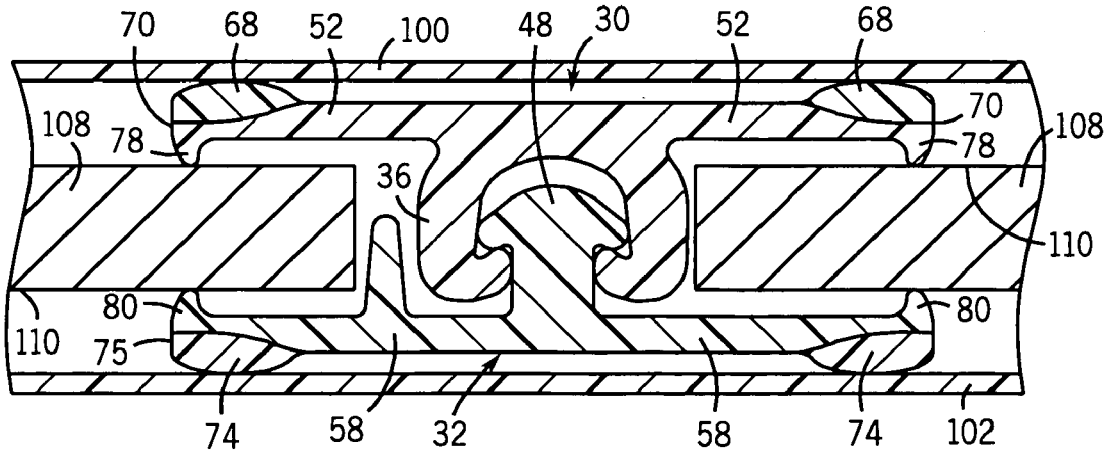
FIG. 4 is a section view illustrating the positioning of the reclosable zipper relative to a pair of zipper guide plates prior to attachment of the reclosable zipper to the flexible web.

Referring now to FIG. 4, once the web material 100, 102 is brought into contact with the sealant layers 68, 74, the first and second profile members 30, 32 are brought into registration with a pair of spaced zipper guide plates 108. The zipper guide plates 108 are preferably formed form a metallic material and are positioned between the flanges 52 of the first profile member 30 and the flanges 58 of the second profile member 32. Each of the guide plates 108 extends inwardly from the outer edges 70, 75 of the first and second profile members 30, 32 to a location spaced from the interlocking closure elements 36, 48. The guide plates 108 provides support for the flanges of the first and second profile members and aid in preventing the profile members from becoming sealed to each other during the application of heat required to attached the zipper closure to the first and second webs 100, 102.

As illustrated in FIG. 4, the standoff areas of the first profile member 30 and the standoff areas 80 of the second profile member 32 each contact and engage an outer surface 110 of the guide plates 108. The interaction between the standoff areas 78, 80 and the guide plates 108 provides additional support for the outer edges of each of the flanges 52, 58. Since each of the standoff areas 78, 80 is generally aligned with one of the sealant layers 68, 74, the support created by the standoff areas 78, 80 is generally aligned with the sealant layers 68, 74.

Figure 5:
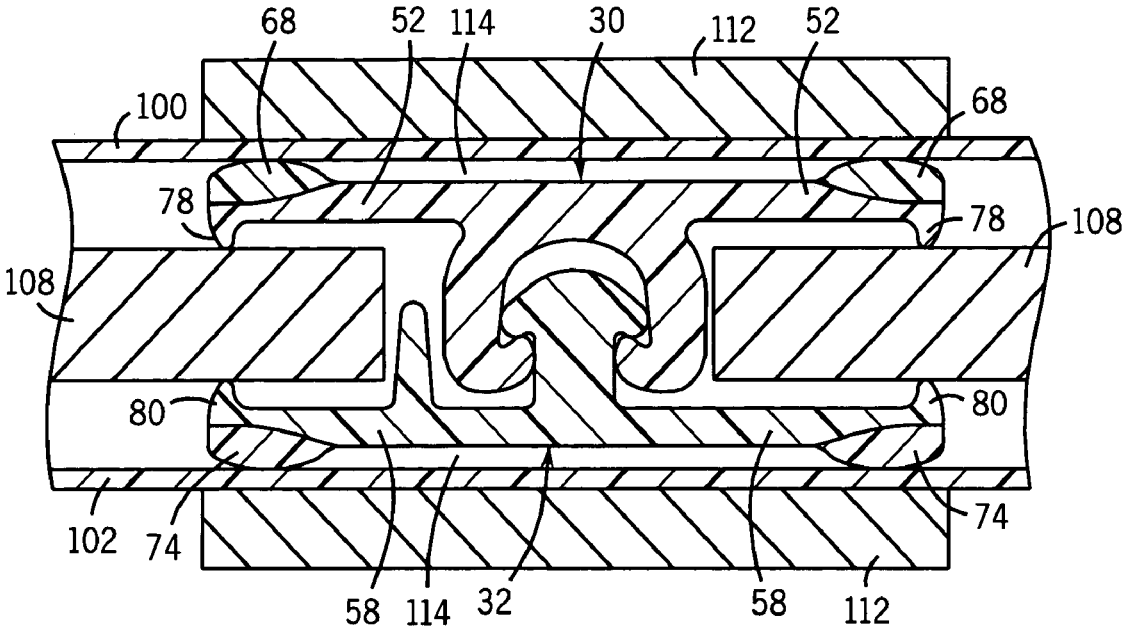
FIG. 5 is a section view illustrating the application of a pair of heated sealing bars to the reclosable package during formation.

Referring now to FIG. 5, thereshown is a pair of heated sealing bars 112 being brought into contact with the first and second webs 100, 102. As the heated sealing bars 112 are brought into contact with the webs 100, 102, the heat provided by the sealing bars 112 causes each of the sealant layers 68 and 74 to melt. Since each of the sealant layers 68, 74 are formed from a different material than the flanges 52, 58 and bases 34, 46 of the first and second profile members 30, 32, the initial application of heat will cause only the sealant layers 68, 74 to melt.

Figure 6:
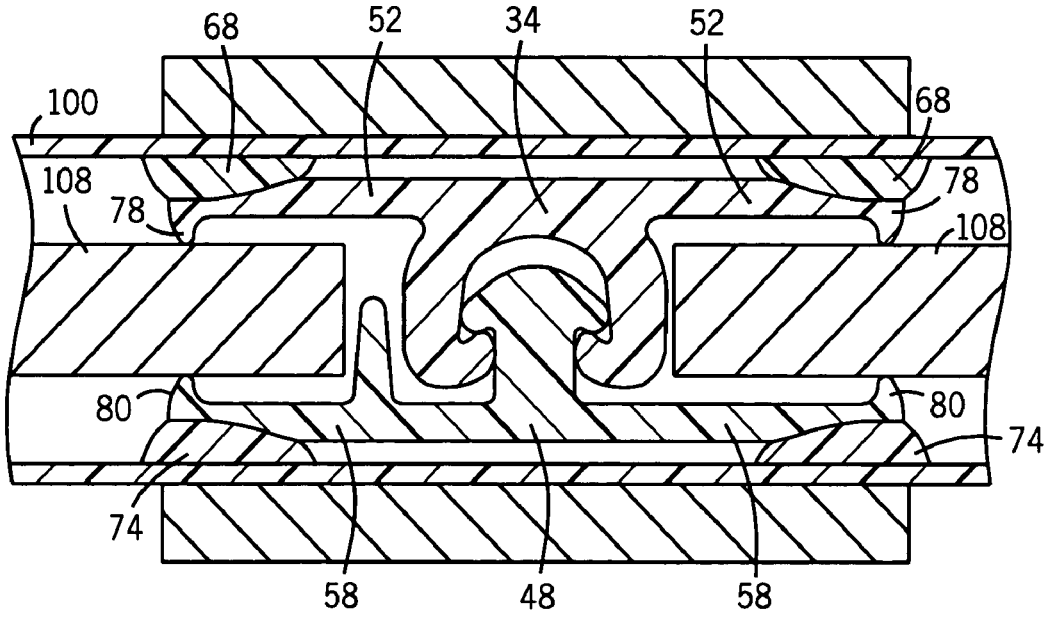
FIG. 6 is a section view illustrating the reclosable zipper as securely attached to the side panels of a reclosable package.

As illustrated in FIG. 6, once the sealant layers 68, 74 have melted, the sealant layers form a bond between the flanges 52 and the first web 100 and between the flanges 58 and the second web 102. However, as can be understood in FIG. 5, the teardrop shape of each of the sealant layers 68, 74 creates an open air gap 114 that prevents the web material 100, 102 from sealing to the outer surface of the first and second profile members 30, 32.

As illustrated in FIG. 6, once the sealant layer has been melted and the zipper closure 26 attached to the layers of web material 100, 102, a slight space exists between the outer surface of each base portion 34, 46 and the respective layer of web material 100, 102.

Referring back to FIG. 5, during the application of the heated sealing bars 112, the heated sealing bars 112 exert an inward pressure between the layers of web material 100, 102 and the respective profile member. As clearly illustrated, the standoff areas 78, 80 are generally aligned with the sealant layers 68, 74 such that during the pressure applied by the sealing bars 112, the standoff areas 78, 80 provide additional support and increase the contact between the sealing layers 68, 74 and the layers of web material 100, 102. As can be understood, if the standoff areas 78, 80 were eliminated, each of the flanges 52, 58 would deflect inward and thus reduce the pressure contact between the sealant layers 68, 74 and the web material 100, 102. Thus, the standoff areas 78, 80 aid in increasing the seal between the first and second profile members 30, 32 and the layers of web material 100, 102.

Having described the presently preferred embodiments, it is to be understood that the invention may be otherwise embodied within the scope of the appended claims.

What is claimed is:

1. A reclosable zipper for positioning between two layers of web material comprising:

a first profile member having a base, an interlocking closure element extending from the base and at least one flange extending from the base, the flange having an inner surface and an outer surface;

a second profile member having a base, an interlocking closure element extending from the base and at least one flange extending from the base, the flange having an inner surface and an outer surface;

a first sealant layer formed on the outer surface of at least one flange of the first profile member and a second sealant layer formed on the outer surface of at least one flange of the second profile member, the first sealant layer and the second sealant layer protruding from the flanges wherein the first sealant layer and second sealant layer have a generally teardrop shape to define an open air gap between the first profile member and a first layer of web material and the second profile member and a second layer of web material;

and a standoff area formed on the inner surfaces of the flanges having the first sealant layer and the second sealant layer.

2. The reclosable zipper of claim 1 wherein the standoff area formed on the inner surfaces of the flanges is generally aligned with the first sealant layer and the second sealant layer.

3. The reclosable zipper of claim 1 wherein the first profile member and the second profile member are formed from a first material and the first sealant layer and the second sealant layer is formed from a second material.

4. The reclosable zipper of claim 3 wherein the second material is a heat activated adhesive.

5. The reclosable zipper of claim 3 wherein the standoff area is formed from the first material.

6. The reclosable zipper of claim 1 wherein the first sealant layer and the second sealant layer are extruded with the first and second profile members.

7. The reclosable zipper of claim 1 wherein each flange of the first and second profile members includes an edge spaced from the interlocking closure element, the first sealant layer and the second sealant layer being formed on the edge of the respective flange.

8. The reclosable zipper of claim 1 wherein each of the first and second profile members includes a pair of flanges, the first sealant layer being formed on the pair of flanges of the first profile member and the second sealant layer being formed on the pair of flanges of the second profile member.

9. The reclosable zipper of claim 1, wherein the first profile member includes a pair of flanges and the second profile member includes a pair of flanges.

10. The reclosable zipper of claim 9 further comprising a pair of standoff areas formed on the inner surface of each flange of both the first profile member and the second profile member.

11. The reclosable zipper of claim 10 wherein each of the standoff areas is generally aligned with the first sealant layer and second sealant layer.

12. The reclosable zipper of claim 9 wherein the pair of flanges on the first profile member extend in opposite directions from the base of the first profile member and the pair of flanges of the second profile member extend in opposite directions from the base of the second profile member.

13. The reclosable zipper of claim 1 wherein the first profile member and second profile member are formed with low density polyethylene and the first sealant layer and second sealant layer are formed with a material with a lower melting point than the low density polyethylene.

14. A reclosable zipper for positioning between two layers of web material comprising:

a first profile member having a base, an interlocking closure element extending from the base and a pair of flanges each extending from the base, each flange having an inner surface, an outer surface and an edge spaced from the interlocking closure element;

a second profile member having a base, an interlocking closure element extending from the base and a pair of flanges each extending from the base, each flange having an inner surface, an outer surface and an edge spaced from the interlocking closure element;

a first sealant layer formed on the outer surface of at least one flange of the first profile member and a second sealant layer formed on the outer surface of at least one flange of the second profile member, the first sealant layer and the second sealant layer protruding from the outer surfaces of the flanges wherein the first sealant layer and second layer have a generally teardrop shape to define an open air gap between the first profile member and a first layer of web material and the second profile member and a second layer of web material.

15. The reclosable zipper of claim 14 wherein the first profile member and the second profile member are formed from a first material and the first sealant layer and the second sealant layer are formed from a second material.

16. The reclosable zipper of claim 14 wherein each flange of the first profile member includes a sealant layer and each flange of the second profile member includes a sealant layer.

17. The reclosable zipper of claim 14 wherein the first profile member and second profile member are formed with low density polyethylene and the first sealant layer and second sealant layer are formed with a material with a lower melting point than the low density polyethylene.

* * * * *